US007307590B1

(12) United States Patent
Tonn

(10) Patent No.: US 7,307,590 B1
(45) Date of Patent: Dec. 11, 2007

(54) WIDEBAND TRAVELING WAVE MICROSTRIP ANTENNA

(75) Inventor: David A. Tonn, Charlestown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 34 days.

(21) Appl. No.: 11/444,810

(22) Filed: May 19, 2006

(51) Int. Cl.
*H01Q 1/38* (2006.01)
*H01Q 13/12* (2006.01)
*H01Q 1/48* (2006.01)

(52) U.S. Cl. ..... 343/700 MS; 343/769; 343/846

(58) Field of Classification Search ..... 343/700 MS, 343/769, 770, 846, 848
See application file for complete search history.

(56) References Cited

U.S. PATENT DOCUMENTS 3,806,946 A 4/1974 Tiuri et al.
3,984,834 A 10/1976 Kaloi
4,468,675 A 8/1984 Robinson
4,812,855 A 3/1989 Coe et al.
5,329,287 A 7/1994 Strickland
5,546,096 A 8/1996 Wada
5,548,297 A * 8/1996 Arai ..... 343/700 MS
5,548,299 A 8/1996 Tsuda et al.
5,712,647 A 1/1998 Shively
6,018,323 A 1/2000 Van Hoozen et al.
6,597,316 B2 * 7/2003 Rao et al. ..... 343/700 MS
7,061,431 B1 * 6/2006 Tonn ..... 343/700 MS

* cited by examiner

*Primary Examiner*—Shih-Chao Chen
(74) *Attorney, Agent, or Firm*—James M. Kasischke; Jean-Paul A. Nasser; Michael P. Stanley

(57) ABSTRACT

The present invention by propagates a traveling wave of electric current along a microstrip antenna structure rather than a standing wave. By loading an antenna with a series of capacitive gaps of the correct values, the shape of the electric current distribution can be tailored to suppress the resonant properties of the antenna, specifically the standing wave of electric current that normally forms along the antenna structure. A microstrip antenna having a "bulls-eye target" structure comprised of a center disk and concentrically larger capacitively coupled annular sections will tailor the shape of the electric current distribution to achieve a suppression of the resonant properties of the antenna, thereby increasing the antenna bandwidth.

1 Claim, 1 Drawing Sheet

WIDEBAND TRAVELING WAVE MICROSTRIP ANTENNA

STATEMENT OF GOVERNMENT INTEREST

The invention described herein may be manufactured and used by or for the Government of the United States of America for governmental purposes without the payment of any royalties thereon or therefore.

CROSS REFERENCES TO OTHER PATENT APPLICATIONS

N/A

BACKGROUND OF THE INVENTION (1) Field of the Invention

The present invention is directed to microstrip antennas, and more specifically to a microstrip radiator that has wideband capabilities.

(2) Description of the Prior Art

In the past, microstrip antennas have been used in numerous forms and applications, but all of them suffered from the limitation imposed by their inherent narrow bandwidths. In situations where wideband performance (more than 5-10%) was required, microstrip antennas of differing sizes had to be stacked or interlaced in order to try to provide the proper band coverage for the application. This led to antennas that were large, had complex feed configurations, and were very expensive to produce and operate. One of the basic characteristics of a microstrip antenna that limits its bandwidth is its resonant behavior. The resonance of a normal antenna, due to the reflection of the electric current wave at the open-circuited ends of the antenna causes a standing wave of electric current to form along the antenna structure. This standing wave can only be efficiently supported when the antenna's length is a multiple of a half wavelength (for center-fed dipole antennas). As the antenna's length moves away from these select wavelengths, the antenna will not operate efficiently, hence limiting its bandwidth. What is needed is an antenna that provides greatly improved bandwidth performance over current microstrip antennas, without the cumbersome task of having to stack or interlace antenna elements of different sizes in order to achieve wider band widths.

SUMMARY OF THE INVENTION

It is a general purpose and object of the present invention to disclose a microstrip antenna that achieves superior bandwidth performance.

It is a further object of this invention to achieve superior band width performance by suppressing the resonant behavior of the microstrip antenna through distributed reactive loading.

The above objects are achieved with the present invention by propagating a traveling wave of electric current along a microstrip antenna structure rather than a standing wave. By loading an antenna with a series of capacitive gaps of the correct values, the shape of the electric current distribution can be tailored to suppress the resonant properties of the antenna. A microstrip antenna having a "bulls-eye target" structure comprised of a central disk and concentrically larger capacitively coupled annular sections will tailor the shape of the electric current distribution to achieve a suppression of the resonant properties of the antenna, thereby increasing the antenna bandwidth.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings, wherein like reference numerals refer to like parts and wherein.

DETAILED DESCRIPTION

Figure 1:
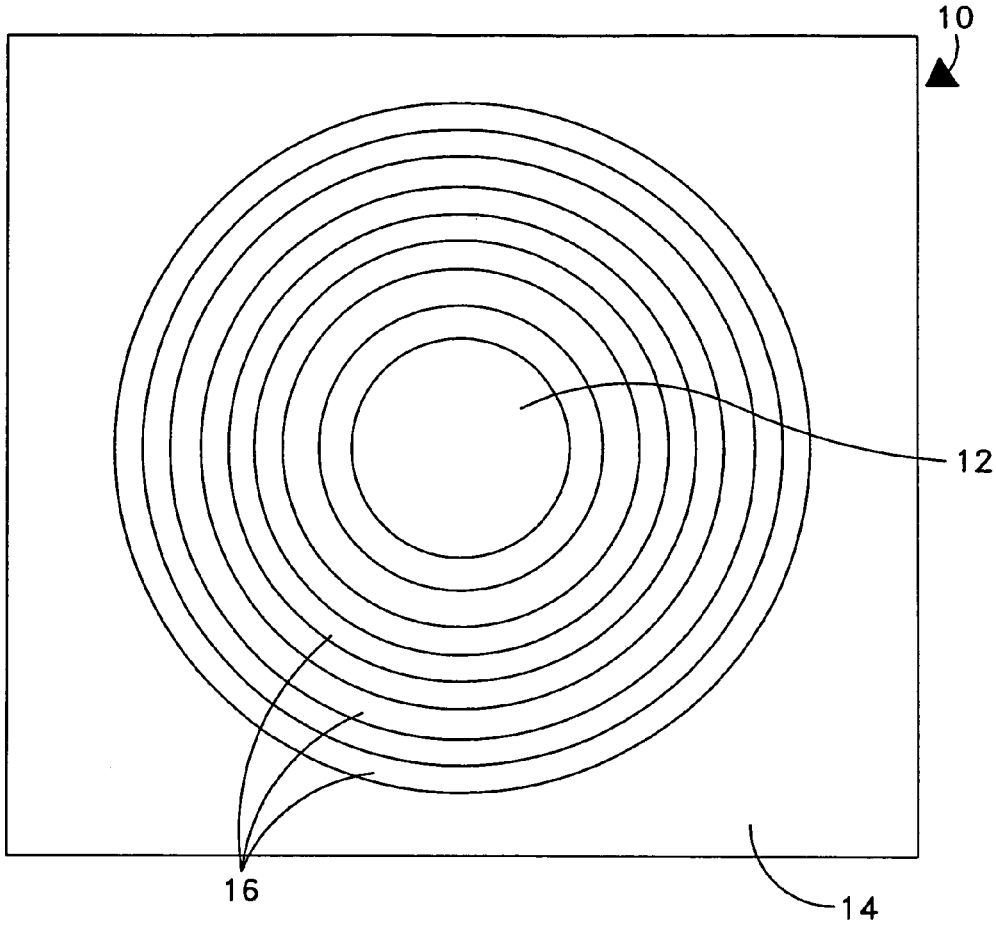
FIG. 1 is an illustration of the top view of a microstrip antenna with a "bulls-eye target" structure.
Figure 2:
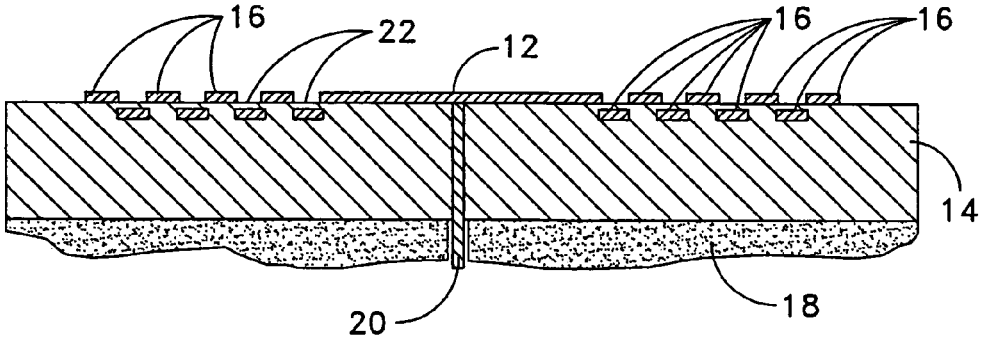
FIG. 2 is an illustration of the side cross-sectional view of a microstrip antenna with a "bulls-eye target" structure affording a view of the annular sections embedded beneath the surface of the dielectric.

Referring to FIG. 1 and FIG. 2, there is shown a microstrip patch antenna 10 having a "bulls-eye target" configuration. The antenna consists of a center disk 12, which is a conductor, positioned on a dielectric substrate 14. The dielectric substrate is positioned on a ground plane 18. The antenna also consists of annular sections 16 each having a different diameter. Each annular section 16 is also a conductor. The annular sections 16 are situated both on the surface of the dielectric substrate 14 and embedded beneath the surface of the dielectric substrate 14. The size of the annular sections 16 depends on the frequency of the antenna. Typically, a minimum of 5 or 6 segments are needed to create enhanced bandwidth, the greater the number of segments, the greater potential for increased bandwidth. The annular sections 16 are arranged in a progressively concentric pattern starting from the center disk 12 such that each annular section 16 on the surface of the dielectric substrate 14 overlaps neighboring annular sections 16 embedded in the dielectric substrate 14. Typically, an annular section 16 is buried on the order of thousandths of an inch in the dielectric substrate 14. However, how deeply embedded the annular sections 16 are depends on the type of dielectric material used, the size of the antenna (which depends on the frequency of the antenna), and the amount of capacitance needed, which depends on both the frequency of operation and the size of the antenna.

The center disk 12 of the antenna 10 is connected to a coaxial probe feed 20. Energy is launched in a radial direction from the center disk 12 and passes through a series of capacitive gaps 22. The capacitive gaps 22 are formed due to the overlapping annular sections 16 and serve to capacitively couple the annular sections 16. The capacitance of these gaps 22 is chosen so as to provide a decreasing amount of capacitance as the electric current wave travels in a radial direction outward and away from the center disk 12, thereby producing a radial traveling wave of current. The size of the capacitive gaps 22 depends on the amount of capacitance needed, which in turn depends on the size of the antenna, which in turn depends on the operating frequency. The capacitance is controlled by the amount of overlap in the annular sections 16. In one embodiment, the capacitance of the gaps 22 decreased exponentially for each successive gap 22 moving outwardly and away from the center disk 12. As a general rule, however, the capacitance in the gap between the center disk 12 and the first annular segment should be the largest capacitance. The capacitance in the gap between the first annular segment and the second annular segment should be the second largest capacitance. This pattern continues with each successive gap 22 in a direction away from the center disk 12. The capacitance of each gap 22 may decrease by the same or variable proportions depending on the desired effect.

Loading the antenna 10 with a series of capacitive gaps 22 causes the magnitude of the electric current wave to decrease as the wave propagates in a radial direction away from the center disk 12. At the edge of the outermost annular section 16 there is little energy remaining in the electric current wave to be reflected back toward the coaxial probe feed 20 to produce a standing wave. The effect of this new electric current distribution is a significant increase in the bandwidth of the antenna.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s). Therefore, it will be understood that the appended claims are intended to cover all such modifications and embodiments, which would come within the spirit and scope of the present invention.

What is claimed is:

1. A microstrip patch antenna comprising:

a ground plane;

a dielectric substrate disposed over said ground plane;

a center disk made of an electrically conductive material and positioned on said dielectric substrate;

a plurality of annular sections made of an electrically conductive material, wherein said plurality of annular sections have different diameters and are situated both on the surface of the dielectric substrate and embedded beneath the surface of the dielectric substrate, and wherein said plurality of annular sections are arranged in a progressively concentric pattern starting from the center disk such that each of said plurality of annular sections that is on the surface of the dielectric substrate overlaps at least one of said plurality of annular sections that is embedded beneath the surface of the dielectric substrate;

a coaxial probe feed connected to said center disk wherein said probe feed conducts electrical energy that is launched in a radial direction from the center disk; and a plurality of capacitive gaps, wherein said gaps are formed by the overlapping of said plurality of annular sections and serve to capacitively couple said plurality of annular sections, wherein the capacitance of each of these gaps decreases the further the gap is from the central disk, wherein as an electric current wave travels in a radial direction outward from the center disk said electric current wave passes through said plurality of capacitive gaps thereby producing a radial traveling wave of electric current.

* * * * *